US006857502B2

(12) United States Patent
Naito

(10) Patent No.: US 6,857,502 B2
(45) Date of Patent: Feb. 22, 2005

(54) ENGINE MUFFLER AND METHOD OF MANUFACTURING THE SAME

(75) Inventor: Takahiko Naito, Kawaguchi (JP)

(73) Assignee: Sankei Kigen Kogyo Kabushiki Kaisya, Tokyo (JP)

( * ) Notice: Subject to any disclaimer, the term of this patent is extended or adjusted under 35 U.S.C. 154(b) by 145 days.

(21) Appl. No.: 09/957,400

(22) Filed: Sep. 21, 2001

(65) Prior Publication Data

US 2002/0088667 A1 Jul. 11, 2002

(30) Foreign Application Priority Data

Jan. 11, 2001 (JP) ..... P2001-003787

(51) Int. Cl.[7] ..... F01N 1/00; F01N 1/24

(52) U.S. Cl. ..... 181/252; 181/222; 181/256; 29/890.08

(58) Field of Search ..... 181/252, 248, 181/247, 256, 222, 227, 228; 29/890.08; 180/309; 60/687

(56) References Cited

U.S. PATENT DOCUMENTS

| | | | | | |
|---|---|---|---|---|---|
| 3,104,732 | A | * | 9/1963 | Ludlow et al. | 181/227 |
| 3,315,761 | A | * | 4/1967 | Selig | 29/890.08 |
| 3,863,445 | A | * | 2/1975 | Heath | 180/309 |
| 4,228,868 | A | * | 10/1980 | Raczuk | 181/252 |
| 5,119,551 | A | * | 6/1992 | Abbott | 29/890.08 |
| 5,266,755 | A | * | 11/1993 | Chien | 181/252 |
| 5,892,186 | A | * | 4/1999 | Flugger | 181/252 |
| 5,992,560 | A | * | 11/1999 | Matsuoka et al. | 181/252 |
| 6,173,800 | B1 | * | 1/2001 | Steenackers et al. | 180/89.2 |
| 6,223,434 | B1 | * | 5/2001 | Morikawa | 29/890.08 |
| 6,438,949 | B1 | * | 8/2002 | Nozaki | 180/309 |

FOREIGN PATENT DOCUMENTS

| | | | | |
|---|---|---|---|---|
| JP | 60-206920 | | 10/1985 | |
| JP | 05187218 | A * | 7/1993 | F01N/1/10 |
| JP | 6-2525 | | 1/1994 | |
| JP | 06241016 | A * | 8/1994 | F01N/1/04 |
| JP | 2001123829 | A * | 5/2001 | F01N/7/14 |

* cited by examiner

*Primary Examiner*—Kimberly Lockett
*Assistant Examiner*—Edgardo San Martin
(74) *Attorney, Agent, or Firm*—Armstrong, Kratz, Quintos, Hanson & Brooks, LLP

(57) ABSTRACT

This engine muffler has a sound absorbing material interposed between an internal tube and an external tube which is formed with a projection projecting toward the sound absorbing material along almost its entire periphery. When interposing the sound absorbing material between the internal tube and the external tube and drawing the end of the external tube for manufacturing the muffler, the projection projecting toward the sound absorbing material is formed on the external tube almost along its entire periphery after inserting the sound absorbing material between the internal tube and the external tube but before drawing the end of the external tube.

8 Claims, 3 Drawing Sheets

ENGINE MUFFLER AND METHOD OF MANUFACTURING THE SAME

BACKGROUND OF THE INVENTION

1. Field of the Invention

The present invention relates to a muffler to be used for the exhaust system of an engine, for example, for automobiles, and a method of manufacturing the same.

2. Description of the Related Art

Hitherto, a muffler to be used for the exhaust system of an engine for automobiles or the like such as a sub muffler to be disposed immediately behind the catalytic converter, a main muffler to be placed at the rear of the exhaust system, or a sound absorbing muffler to be disposed in the main muffler, having a sound absorbing material interposed between the internal tube and the external tube is known.

However, in the muffler described above, the sound absorbing material may lean to one side or be deformed after long time of use due to vibration of the vehicle body, vibration of the engine, or expansion and contraction caused by exhaust heat. Especially, when the axial length of the sound absorbing material interposed between the external and the internal tubes is long, it tends to lean to one side, and when different types of sound absorbing materials multilayered in the direction of thickness tend to be subject to slippage or wrinkles at the mating portion. As a consequent, the sound absorbing material may vary in bulk density and thus lower the sound-muffling capability, or may scatter and thus lowering the durability disadvantageously.

Generally, the muffler as described above is manufactured in such a manner that the sound absorbing material is filled between the internal tube and the external tube, and then the end portion of the external tube is drawn into a tapered shape. In this case, the sound absorbing material is secured by a jig or the like so as not to be displaced in the related art. However, when the diameter of the tapered end decreases, the structure of the jig becomes complex, and there may be cases where it cannot be secured by a jig.

SUMMARY OF THE INVENTION

With such circumstanced in view, it is an object of the present invention to provide a durable and easy-to-manufacture engine muffler by securing the sound absorbing material reliably during use or during manufacturing process, and a method of manufacturing the same.

In order to achieve the object described above, an engine muffler and a method of manufacturing the same according to the present invention have the following structure.

The engine muffler of the present invention comprises a sound absorbing material interposed between the external tube and the internal tube, wherein a projection that projects toward the sound absorbing material is formed on the external tube along almost entire periphery thereof.

A method of manufacturing the engine muffler according to the present invention comprises the steps of interposing a sound absorbing material between the internal tube and the external tube, and drawing the end portion of the outer tube, wherein a projection that projects toward the sound absorbing material is formed on the external tube along almost entire periphery thereof after inserting the sound absorbing material between the external tube and the internal tube, but before drawing the end portion of the external tube.

The advantages offered by the engine muffler and the method of manufacturing the same according to the present invention are mainly that leaning of the sound absorbing material to one end or occurrence of wrinkles thereon due to slippage thereof during manufacturing or usage of the muffler can be prevented only by a very simple structure, or by simply providing a projection projecting toward the sound absorbing material on the external tube. Therefore, this type of muffler can be manufactured easily at low cost, and lowering of sound eliminating capability or durability can preferably be prevented.

BRIEF DESCRIPTION OF THE DRAWINGS

FIG. 3A is a cross sectional front view showing a state in which the muffler is suspended from the vehicle body via a stay or the like;

DESCRIPTION OF THE PREFERRED EMBODIMENTS

An engine muffler and a method of manufacturing the same according to the present invention will be described in detail referring to the embodiment shown in the figures.

Figure 1:
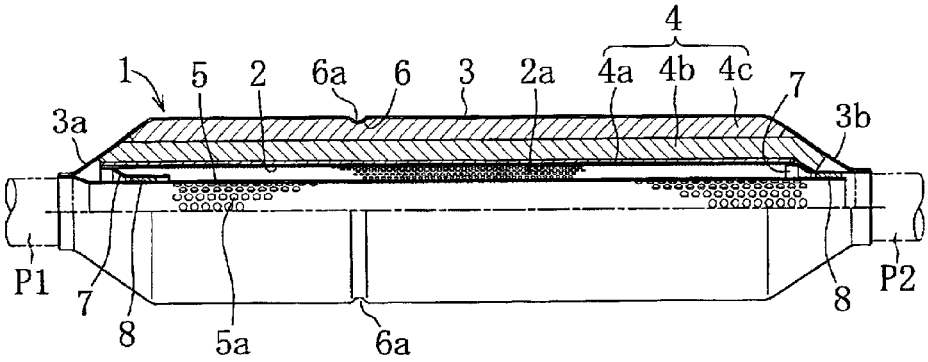
FIG. 1 is a partially cross sectional side view showing an embodiment of the engine muffler according to the present invention.
Figure 2:
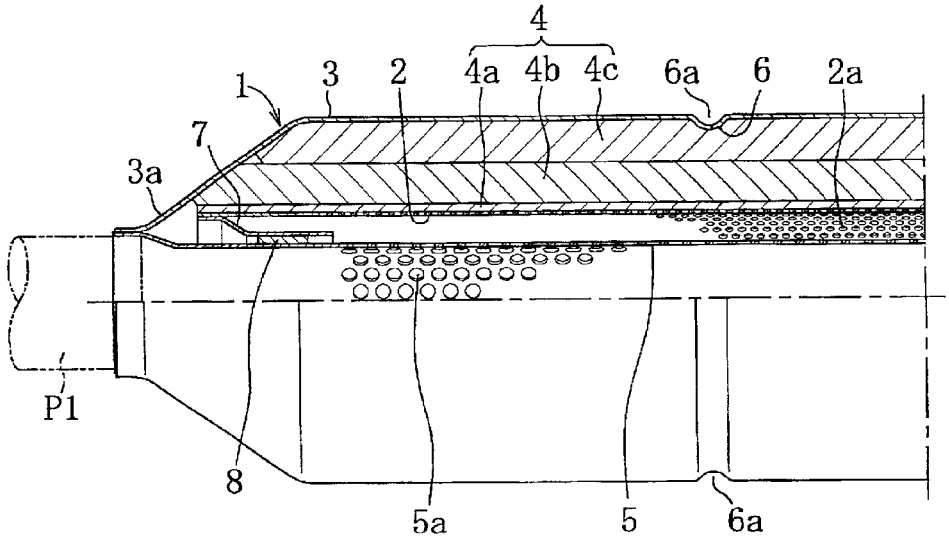
FIG. 2 is an enlarged view showing the left half portion of the muffler shown in FIG. 1.

In this embodiment, the present invention is applied to the sub-muffler to be disposed immediately behind the catalytic converter that is disposed relatively upstream of the engine exhaust system for automobiles. Referring now to FIG. 1 and FIG. 2, the muffler 1 comprises a sound absorbing material 4 interposed between the internal tube 2 and the external tube 3 and an exhaust air guiding tube 5 provided inside the internal tube 2.

The sound absorbing material 4 is formed of a plurality of kinds of sound absorbing materials 4*a*–4*c* having different properties in heat-resistance and sound absorbing capability multilayered in the direction of thickness. In the case shown in the figure, a sound absorbing material 4*a* formed of a heat-resisting material such as stainless wool is arranged on the outer periphery of the internal tube 2, and a sound absorbing material 4*b* formed of a heat-resisting material such as glass wool that absorbs the sound better than the sound absorbing material 4*a*, and a sound absorbing material 4*c* formed of a sound absorbing material such as glass wool that is less expensive than the sound absorbing material 4*b* are arranged on the outer periphery thereof. The sound absorbing material 4*a* also has a function to prevent the sound absorbing materials 4*b*, 4*c* from dispersing.

The internal tube 2 and the exhaust air guiding tube 5 are formed respectively with a number of through holes 2*a*, 5*a* having different diameters so that the exhaust sound passing through the exhaust air guiding tube 5 is absorbed and eliminated through the through holes 2*a*, 5*a*. The both ends 3*a*, 3*b* of the external tube 3 are drawn into tapered shapes, and the lengthwise mid section of the external tube 3 is formed with a projection 6 projecting toward the sound absorbing material 4 along almost entire periphery thereof by the use of a pressing roller or the like.

In the figure, the reference numeral 7 designates a short cylinder interposed between the internal tube 2 and the exhaust air guiding tube 5 at both ends for maintaining a space therebetween, and a spacer 8 formed of metal mesh or the like is interposed between the short cylinder 7 and the exhaust air guiding tube 5.

When mounting the muffler 1 constructed as described above in the exhaust system of an engine for automobiles, the exhaust pipes P1, P2 are connected to both ends of the muffler 1. Therefore, the sound absorbing material 4 placed between the internal tube 2 and the external tube 3 is held by the projection 6, and thus is prevented from leaning to one side or being deformed even when vibrations from the engine or of the vehicle body act on the muffler 1. Even when the axial length of the sound absorbing material interposed between the internal tube and the external tube is long, leaning to one side can be prevented. In addition, in the structure in which sound absorbing materials of different kinds are multilayered in the direction of thickness as shown in the figure, occurrence of slippage or wrinkles at the mating portion is reliably prevented.

Figure 3A:
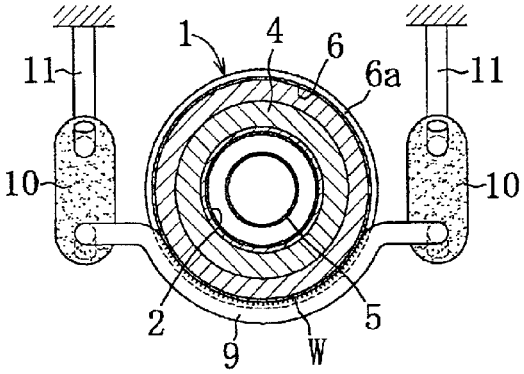
Figure 3B:
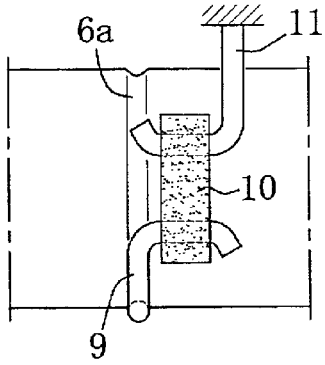
FIG. 3B is a side view of the muffler in FIG. 3A.

When the projection 6 projecting toward the sound absorbing material 4 or inwardly is formed on the external tube 3 by the use of a pressing roller or the like, the outer surface of the projection 6 is naturally formed with a recess 6*a*, which helps to mount a stay or the like for mounting the muffler 1 to the vehicle body easily and reliably. FIG. 3 shows an example, in which a stay 9 of arcuate shape in front view is mounted in the recess 6*a* formed on the external tube 3 by welding W, and both ends of the stay 9 is suspended from the hanger 11 provided on the bottom portion of the vehicle body via a damping material 10 such as a rubber dumper.

When welding the stay 9, it can easily be positioned by the use of the recess 6*a*. In addition, by fitting the stay 9 into the recess 6*a*, it can be welded over a wide area of the stay 9 kept in contact with the external tube 3, and the stay 9 is provided integrally in the recess 6*a* along the projection 6. Therefore, the stay 9 can easily and rigidly mounted to the muffler 1.

When manufacturing the muffler as is described above, the sound absorbing material 4 is filled between the internal tube 2 and the external tube 3 before drawing at least one end or both ends of the external tube 3 into a tapered shape. In this case, the projection 6 described above is preferably formed after the sound absorbing material 4 is filled but before the end portion of the external tube is subjected to the drawing process.

Figure 4A:
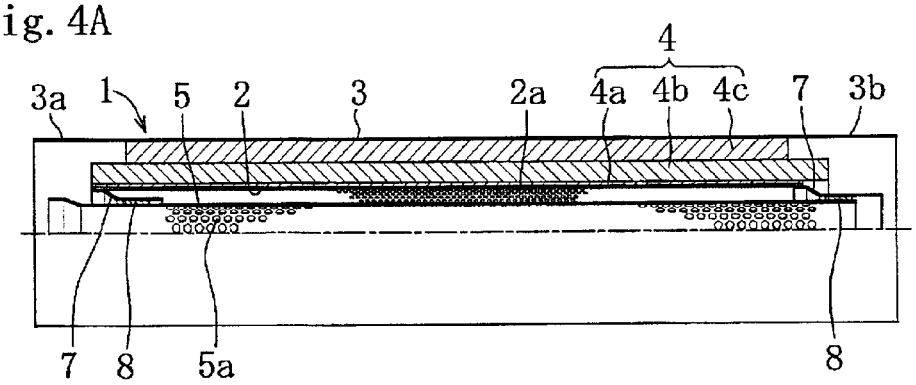
FIGS. 4A and 4B are explanatory drawings showing an example of the process of manufacturing the muffler.
Figure 4B:
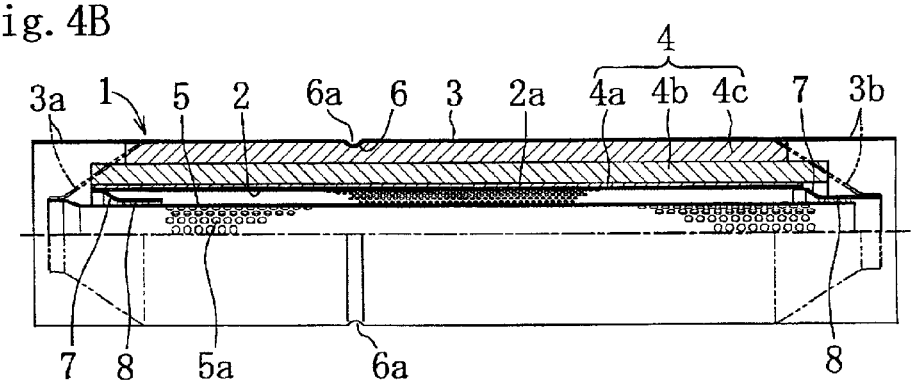
Figure 5A:
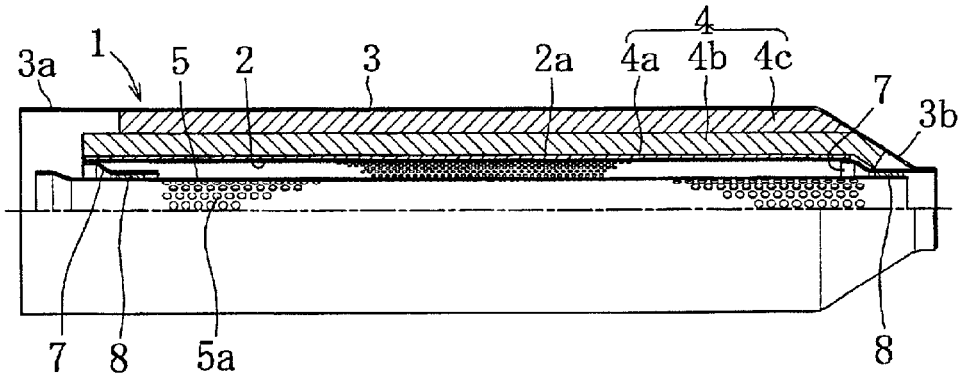
FIGS. 5A and 5B are explanatory drawings showing another example of the process of manufacturing the muffler.
Figure 5B:
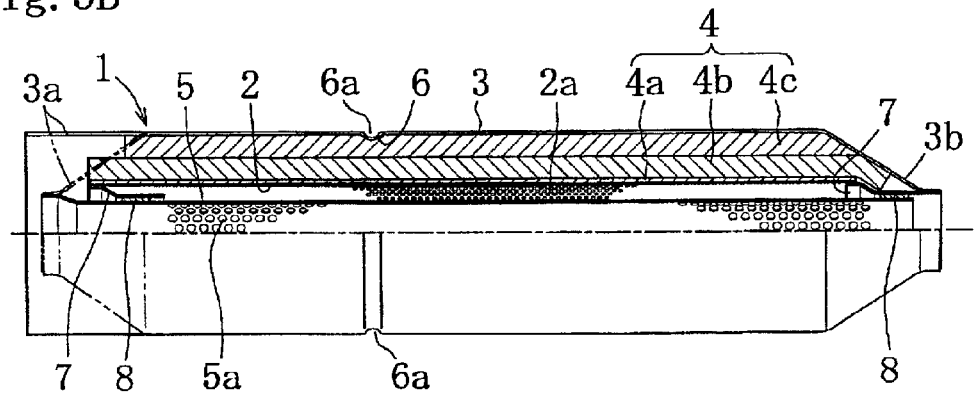

Examples are shown in FIGS. 4A, 4B and FIGS. 5A, 5B. FIGS. 4A, 4B show the case where a sound absorbing material 4, the internal tube 2, and an exhaust air guiding tube 5 are inserted into the external tube 3 formed generally into a straight tube as shown in FIG. 4A, and then the projection 6 is formed on the external tube 3 by the use of a pressing roller or the like, and subsequently, the both ends 3*a*, 3*b* of the external tube 3 are drawn into the tapered shape by spinning process or the like. FIGS. 5A and 5B show the case where a sound absorbing material 4, the internal tube 2, and the exhaust air guiding tube 5 are inserted into the external tube 3 one end 3*b* of which is drawn into a tapered shape in advance as shown in FIG. 5A, and then the projection 6 is formed on the external tube 3 as described above, and subsequently, the other end 3*a* of the external tube 3 is drawn into a tapered shape.

It is also possible to assemble the exhaust air guiding tube 5 after inserting the sound absorbing material 4 into the external tube 3 and drawing the both ends of the external tube, without assembling it in advance as described above. The projection 6 may also be formed by the use of the machine for drawing the both ends of the external tube. For example, in the case of applying a spinning process as described above, it can be formed by means of a pressing roller to be used in the spinning process. In this case as well, formation of the projection 6 is preferably be carried out after inserting the sound absorbing material 4 between the internal tube and the external tube 2, 3 but before drawing process is made or finished.

By forming the projection 6 projecting toward the sound absorbing material 4 on the external tube 3 after inserting the sound absorbing material 4 between the internal tube 2 and the external tube 3 but before drawing the end portion of the external tube, that is, before carrying out the drawing process, or in some cases, simultaneously therewith, the engine muffler can be preferably manufactured without occurrence of slippage or wrinkles at the mating portion of the sound absorbing materials even without a complex jig for securing the internal tube 2 or the sound absorbing material 4 as in the case of the a related art.

While the projection 6 is formed continuously along the whole periphery of the external tube 3 into a arcuate shape in cross section in the embodiment described thus far, the cross sectional configuration is arbitrary. It is also possible to form a number of raised or dotted projections along the periphery thereof. While the projection 6 is formed at one position along the length of the external tube 3 in the example shown in the figure, it is also possible to provide the same at a plurality of positions. While a muffler including an exhaust air guiding tube 5 within the internal tube 2 is shown in the figure as an example, it can also be applied to the muffler without such an exhaust air guiding tube 5.

What is claimed is:

1. An engine muffler comprising an internal tube and an external tube concentrically spaced therefrom and defining a concentric space therebetween, a sound absorbing material substantially filling said space, and a projection projecting into the sound absorbing material formed in the external tube in spaced relation from said internal tube and extending substantially about the entire periphery of said external tube.

2. An engine muffler as set forth in claim 1, wherein the sound absorbing material comprises a plurality of kinds of sound absorbing materials having different heat resisting properties and sound absorbing capabilities, and is interposed between said tubes in a state of being multilayered in the direction of thickness.

3. An engine muffler as set forth in claim 2, wherein the sound absorbing material comprises stainless wool disposed on the outer periphery of the internal tube and glass wool layered on the outer periphery thereof.

4. An engine muffler as set forth in claim 1, further comprising an exhaust air guiding tube provided inside of the internal tube.

5. An engine muffler as set forth in claim 1, wherein said projection is defined by a recess pressed inwardly into a portion of the external tube, and including a stay for suspending the muffler from a bottom portion of the vehicle body of an automobile; and said stay engaging the recess along the projection.

6. A method of manufacturing an engine muffler comprising the steps of:

providing a pair of concentrically disposed tubes;

interposing a sound absorbing material, comprising a multilayered plurality of kinds of sound absorbing materials having different heat resisting properties and sound absorbing capabilities to substantially fill a space between an internal tube and an external tube forming said pair of tubes; and thereafter drawing the end of the external tube to form a projection projecting into the sound absorbing material along substantially the entire periphery of the external tube and to a position spaced from said internal tube.

7. A method of manufacturing an engine muffler comprising the steps of: interposing a sound absorbing material between the internal tube external tube; and drawing the end of the external tube, wherein a projection projecting toward the sound absorbing material is formed on the external tube along substantially the entire periphery thereof after inserting the sound absorbing material between the internal tube and the external tube but before drawing the end of the external tube, and wherein a sound absorbing material and the internal tube is inserted into the external tube formed generally into a straight tube in a first place, then a projection is formed on the external tube, and then both ends of the external tube are drawn into a tapered shape.

8. A method of manufacturing an engine muffler comprising the steps of: interposing a sound absorbing material between the internal tube and the external tube; and drawing the end of the external tube, wherein a projection projecting toward the sound absorbing material is formed on the external tube along substantially the entire periphery thereof after inserting the sound absorbing material between the internal tube and the external tube but before drawing the end of the external tube; and wherein a sound absorbing material and an internal tube are inserted into the external tube, one end of which is drawn into a tapered shape in a first place, then a projection is formed on the external tube, and then the other end of the external tube is drawn into a tapered shape.

* * * * *

UNITED STATES PATENT AND TRADEMARK OFFICE

CERTIFICATE OF CORRECTION

PATENT NO. : 6,857,502 B2
APPLICATION NO. : 09/957400
DATED : February 22, 2005
INVENTOR(S) : Takahiko Naito It is certified that error appears in the above-identified patent and that said Letters Patent is hereby corrected as shown below:

On the Cover Page
Item (73) change "Sankei Kigen Kogyo Kabushiki Kaisya" to be -- Sankei Giken Kogyo Kabushiki Kaisya --

Signed and Sealed this

Twenty-fifth Day of September, 2007

JON W. DUDAS
*Director of the United States Patent and Trademark Office*